US011560769B2

(12) United States Patent
Whitney et al.

(10) Patent No.: US 11,560,769 B2
(45) Date of Patent: Jan. 24, 2023

(54) WIRE LINE DEPLOYABLE METAL PATCH STACKABLE SYSTEM

(71) Applicant: Coretrax Americas Ltd., Houston, TX (US)

(72) Inventors: Tyler A. Whitney, Houston, TX (US); Alessandro Caccialuppi, Houston, TX (US); Scott A. Benzie, Houston, TX (US)

(73) Assignee: Coretrax Americas Ltd., Houston, TX (US)

( * ) Notice: Subject to any disclaimer, the term of this patent is extended or adjusted under 35 U.S.C. 154(b) by 0 days.

(21) Appl. No.: 17/707,544

(22) Filed: Mar. 29, 2022

(65) Prior Publication Data

US 2022/0220822 A1 Jul. 14, 2022

Related U.S. Application Data

(63) Continuation of application No. 16/713,954, filed on Dec. 13, 2019, now Pat. No. 11,286,743.

(51) Int. Cl.
*E21B 33/124* (2006.01)
*E21B 23/12* (2006.01)

(52) U.S. Cl.
CPC ..... *E21B 33/124* (2013.01); *E21B 23/12* (2020.05)

(58) Field of Classification Search
CPC .... E21B 43/108; E21B 43/103; E21B 43/105; E21B 43/106
See application file for complete search history.

(56) References Cited

U.S. PATENT DOCUMENTS

2002/0195252 A1* 12/2002 Maguire ..... E21B 43/106 166/380
2003/0047321 A1* 3/2003 Coon ..... E21B 33/10 166/380
2004/0033906 A1* 2/2004 Cook ..... E21B 29/10 507/200
2004/0216889 A1* 11/2004 Fraser ..... E21B 43/106 166/242.6
2005/0161226 A1 7/2005 Duggan et al.
2007/0221374 A1 9/2007 Filippov et al.
2010/0252278 A1 10/2010 Harris et al.
2012/0097391 A1 4/2012 Whiddon
2013/0133901 A1 5/2013 Benzie et al.
(Continued)

FOREIGN PATENT DOCUMENTS

EP 0418056 3/1991

OTHER PUBLICATIONS

International Search Report and Written Opinion for Application No. PCT/US2021/059710 dated Feb. 18, 2022.
(Continued)

*Primary Examiner* — Kipp C Wallace
(74) *Attorney, Agent, or Firm* — Tumey L.L.P.

(57) ABSTRACT

A method and apparatus for patching damaged areas in a well includes a top and a bottom patching section which include an anchor/sealing member for securing the apparatus within the well. One or more extension patch sections are connected between the top and bottom patch sections. The top and bottom patch elements are placed above and below the damaged area to isolate the damaged area from the exterior flow portion of the well.

7 Claims, 5 Drawing Sheets

(56) References Cited

U.S. PATENT DOCUMENTS

| | | | | |
|---|---|---|---|---|
| 2016/0032696 | A1* | 2/2016 | Caccialupi | E21B 43/108 166/207 |
| 2016/0265294 | A1 | 9/2016 | Robertson et al. | |
| 2016/0312584 | A1* | 10/2016 | Hazel | E21B 7/061 |
| 2018/0187528 | A1* | 7/2018 | Di Crescenzo | E21B 43/105 |
| 2019/0048692 | A1* | 2/2019 | Filippov | E21B 23/01 |
| 2021/0108478 | A1 | 4/2021 | Filippov et al. | |
| 2021/0108490 | A1 | 4/2021 | Filippov et al. | |

OTHER PUBLICATIONS

International Search Report and Written Opinion for Application No. PCT/US2021/059705 dated Mar. 3, 2022.
USPTO Issue Notification for U.S. Appl. No. 16/713,954 dated Mar. 9, 2022.

* cited by examiner

WIRE LINE DEPLOYABLE METAL PATCH STACKABLE SYSTEM

CROSS-REFERENCE TO RELATED APPLICATIONS

This application is a continuation of U.S. patent application Ser. No. 16/713,954 filed Dec. 13, 2019, the entire contents of which are incorporated herein by reference thereto.

BACKGROUND OF THE INVENTION

Field of the Invention

This application is directed to a wireline deployable patch system for oil/gas wells and a method for deploying the system in an oil/gas well.

Description of Related Art

Methods and apparatus utilized in the oil and gas industry enable patching of wellbore casing in a borehole to isolate damaged areas such as leaking connections, corroded or damaged areas, etc. Many examples of patching techniques exist including patents, such as UK Pat. No. G82,525,830 owned by the assignee of the present invention. However, prior patching techniques may not be possible or desirable in some applications.

In some cases, the most economical and desirable method of installation of patches in wellbore casings may be deploying and setting the patch utilizing a wireline (WL). However, the length of the patch which can be deployed in the well on the WL is limited. The WL patch system consists of the patch section, the thruster section and the pump section. Due to lifting limitations and lubricator length limitations, all these together cannot exceed 70 ft of length. Thus, the maximum patch length that can be deployed in the well is approximately 40 ft.

Frequently, the length of a zone to be isolated may be significantly longer than 40 ft. The present invention provides a metal patch system and methods for deployment and installation of metal patches of any desirable length utilizing a wireline.

BRIEF SUMMARY OF SOME OF THE PREFERRED EMBODIMENTS

This invention overcomes the above deficiencies in the prior art by the provision of one or more extension patch sections that are connected between a bottom patch section and a top patch section. The top and bottom patch sections each include an anchoring/sealing element. The anchoring/sealing elements having internal diameters less than an internal diameter of the tubular may be expanded by a setting tool to secure the patch to an inner surface of the well, for example casing. The extension patch sections include tubulars with approximately the same inside and outside diameters as the bottom patch section tubular. The bottom portions of the extension patch sections have areas of reduced diameter with the outside diameter slightly less than the inside diameter of the bottom patch section tubular. The extension patch sections are deployed in the well on the setting tool such that their reduced diameter portions are positioned inside the upper part portions of the previous extension tubulars. The setting tool expands the reduced diameter portions to the diameter approximately equal to the inside diameter of the extension tubulars creating sealed connections between the extension tubulars. As a result, the metal patch of any desirable length may be constructed from limited length extension tubulars deployable and stackable on a wire line.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

It is to be understood that the various embodiments of the present invention described herein may be utilized in various orientations, such as vertical, inclined, horizontal, etc., and in various configurations, without departing from the principles of the present invention. In the following description of the representative embodiments of the invention, directional terms, such as "above," "top", "upper" refer to a direction toward the earth surface along a wellbore, and "below," "bottom," "lower" and similar terms refer to direction away from the earth's surface along the wellbore.

Figure 1:
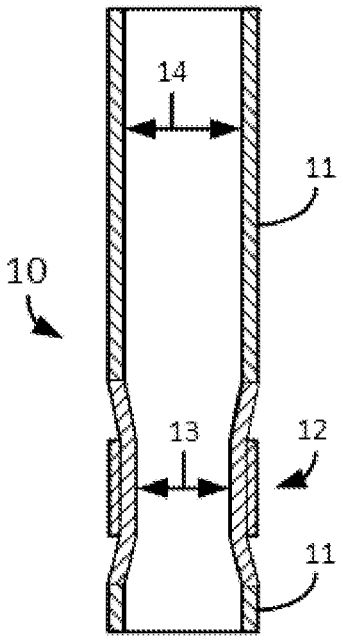
FIG. 1 is a cross sectional view of a bottom patch section according to an embodiment of the invention.
Figure 2:
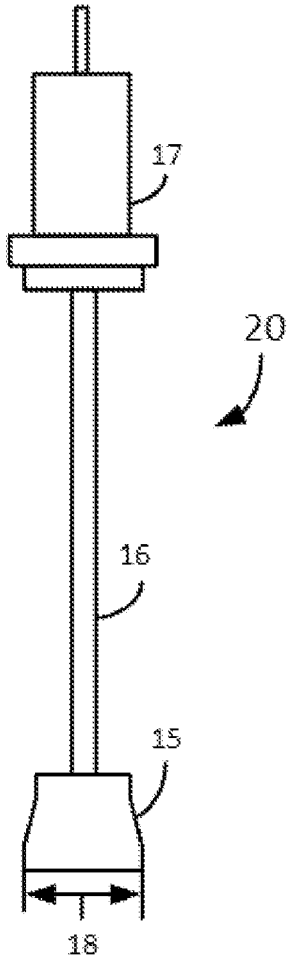
FIG. 2 is a schematic view of a setting tool.
Figure 3:
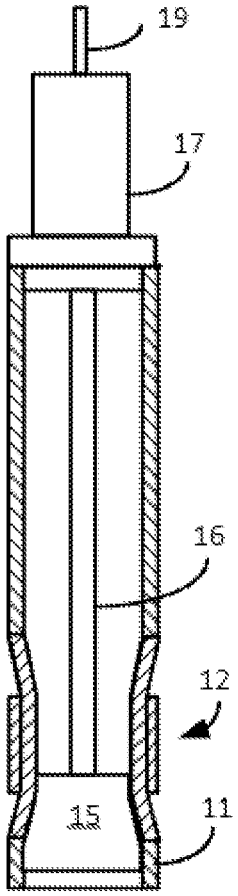
FIG. 3 is a showing of the setting tool coupled to the bottom patch section of FIG. 1.

Referring to FIG. 1, an embodiment of the bottom patch section 10 is a tubular 11 with an anchor/sealing element 12 coupled to the tubular. The anchor/sealing element 12 has an internal diameter 13 less than the internal diameter of the tubular 14. As shown in FIG. 2, a setting tool 20 includes a thruster 17 supported by a wire line 19 and an expansion device 15 such as a cone connected to the thruster via a shaft 16. As shown in FIG. 3 setting tool 20 is secured to the bottom patch section 10 such that expansion device 15 is position below the anchor/sealing element 12.

Figure 4:
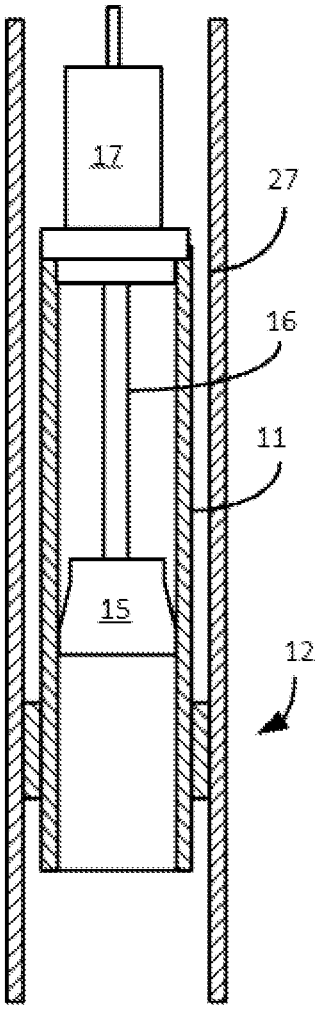
FIG. 4 is a cross sectional view of a bottom patch section set in a wellbore.

As shown in FIG. 4, the bottom patch section 10 is deployed to the desired location in the wellbore and set within the wellbore casing 27, by activating the thruster which provides upward movement of the expansion device 15 which radially plastically expandes the anchor/sealing element 12 to be in interference contact with the inner surface of casing 27.

Figure 5:
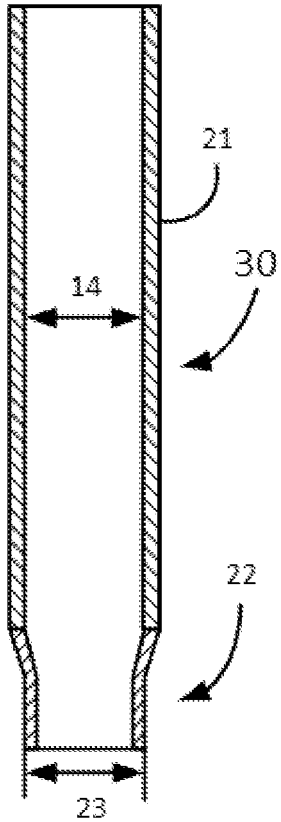
FIG. 5 is a cross sectional view of an extension patch section according to an embodiment of the invention.
Figure 6:
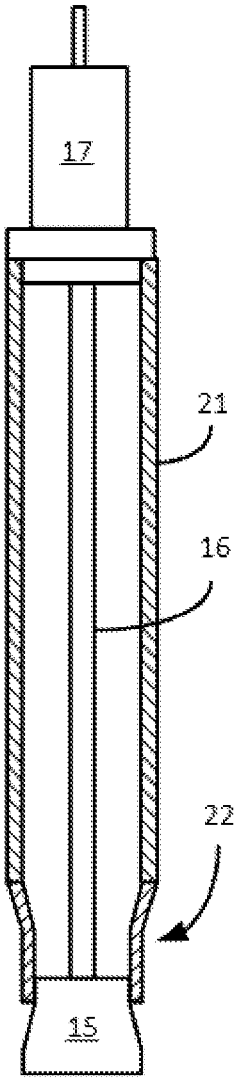
FIG. 6 is a showing of an extension patch section secured to a setting tool.
Figure 7:
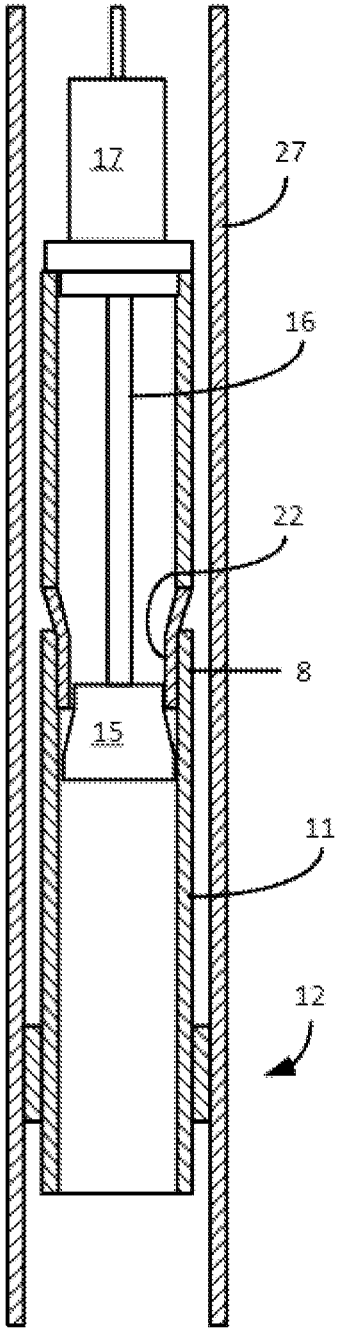
FIG. 7 is a cross sectional view of the extension section positioned such that it's bottom portion is positioned within the upper portion of the previous tubular section.
Figure 8:
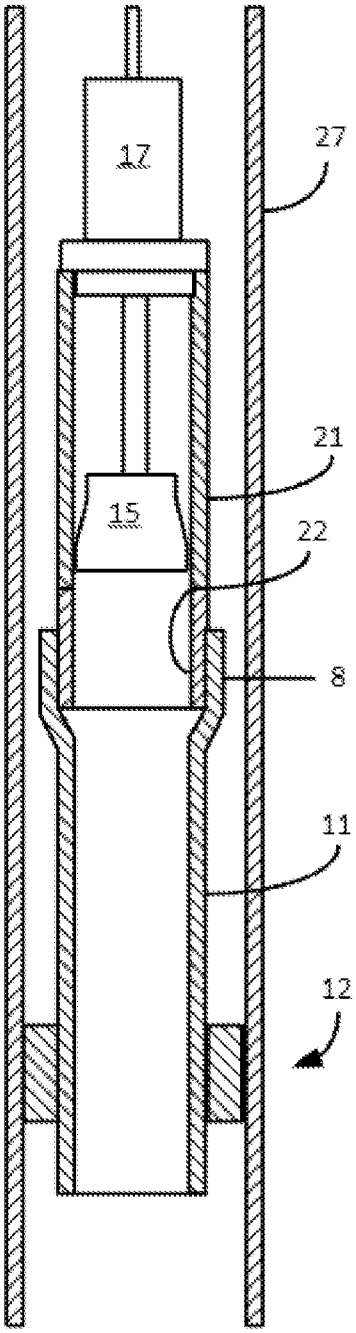
FIG. 8 is a cross sectional view of the bottom portion of the extension patch section being expanded and creating a connection with the bottom patch section within a casing.

As shown in FIG. 5, an embodiment of the extension patch section 30 includes a tubular 21 with a reduced diameter bottom portion 22 having an external diameter 23 slightly less than the internal diameter 14 of the bottom section or a previous extension section. The extension section 30 is secured to the setting tool 20 as shown in FIG. 6 with the expansion cone 15 positioned below the reduced diameter portion 22. Then, the extension section being secured to the setting tool is deployed in the wellbore and the reduced diameter portion 22 is positioned inside upper portion 8 of the bottom tubular 11 as shown in FIG. 7. The extension section is attached to the bottom patch section by activating the thruster 17 and moving the expansion device 15 through the bottom portion of the extension patch section 22 and expanding the internal diameter of the reduced diameter portion to the diameter approximately equal to the inside diameter of the extension tubular creating sealed connections between the tubulars, see FIG. 8. A plurality of extension sections may be connected to each other in a similar fashion.

Figure 9:
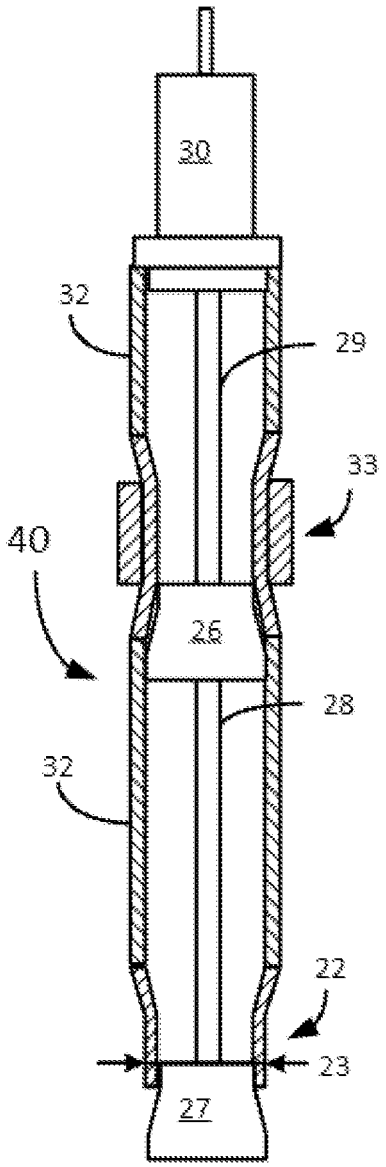
FIG. 9 is a cross sectional view of the top patch section with a setting tool comprising two expansion cones.

As shown in FIG. 9 a top extension patch section 40 includes a tubular 32 having a reduced diameter bottom portion 22 with external diameter 23 less than the internal diameter 14 of the tubular 21, see FIG. 5, and an expandable anchor/seal member 33 coupled to the tubular 32.

Figure 10:
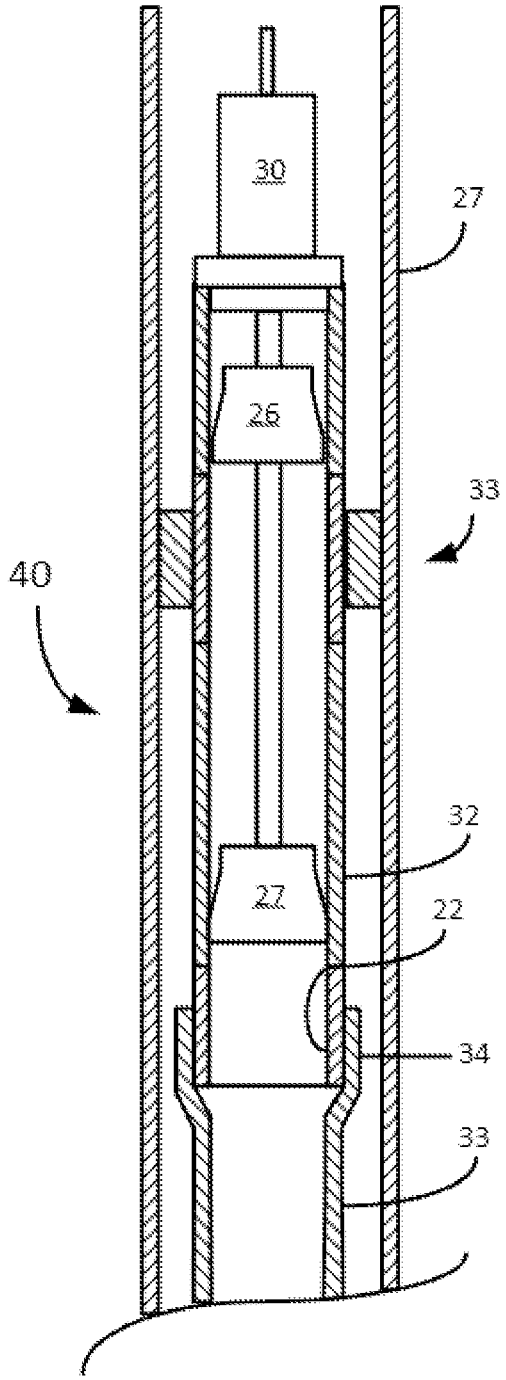
FIG. 10 is a cross sectional view of the top patch section shown in FIG. 9 installed in the well.

The top extension section 40 is secured to the setting tool having expansion device comprising two expansion cones, one, 27, positioned below the reduced diameter bottom portion 22 and the other, 26, below the expandable anchor/sealing member 33, see FIG. 9. The use of the expansion device with two expansion cones allows expansion of both bottom portion 22 and anchor/sealing element in one limited length stroke of the thruster. Then, the top extension section is deployed in the wellbore such that the bottom portion 22 of the top extension tubular 32 is positioned inside the upper portion 34 of the previously set extension tubular 33. The thruster 17 is actuated providing upward movement of the cones 27 and 26 and expanding bottom portion 22 into an upper portion of a lower positioned extension patch section tubular 33 as shown in FIG. 10. The upper cone 26 expands the expandable anchor/seal 33 such that anchor/seal 33 comes into interference contact with the inner surface of the well casing 27, thus anchoring and sealing the top patch section and providing zonal isolation along the whole cumulative length of the patch between the top and bottom anchor/seals.

Figure 11:
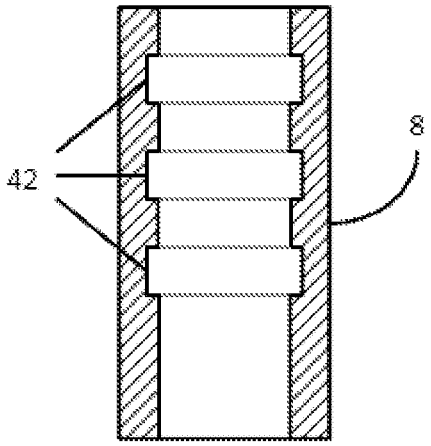
FIG. 11 is a cross sectional view of an upper portion of a tubular comprising grooves.
Figure 12:
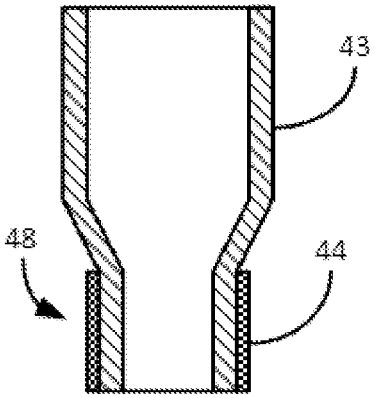
FIG. 12 is a cross sectional view of a bottom portion of an extension patch section comprising an elastomeric sealing/anchoring element.
Figure 13:
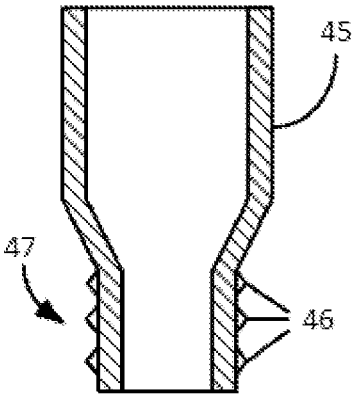
FIG. 13 is a cross sectional view of a bottom portion of an extension section comprising a metal sealing/anchoring element.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to a person skilled in the art upon reference to the description. For example, to provide better sealing/anchoring engagement of the bottom portion of the extension patch tubular into the upper portion of the previous tubular, the upper portion 8 of the previous tubular may have grooves 42, see FIG. 11. Alternatively, the bottom portion of the extension tubulars may have an elastomeric coating, see FIG. 12 or a plurality of anchoring ribs, see FIG. 13, or combination thereof. It is, therefore, intended that the appended claims encompass such modifications or embodiments.

The term anchor/sealing element when used herein includes a sealing element, an anchoring element, or the combination of a sealing and anchoring unit.

What is claimed is:

1. A patching system for patching a section of a well having a casing comprising:

a) a bottom patch section including a tubular comprising an anchor/sealing element coupled to the tubular and having an internal diameter less than the tubular;

b) multiple extension patch sections, each extension patch section comprising an extension tubular having approximately the same inside diameter as the tubular of the bottom patch section, wherein, the extension tubular includes a bottom portion with an outside diameter less than the inside diameter of the tubular of the bottom patch section and the bottom portion having a plurality of ribs on an outer surface of the bottom portion; and c) a setting tool including an expansion device and a thruster which displaces the expansion device, the setting tool capable of expanding the anchor/sealing element thereby bringing the anchor/sealing element in interference contact with an internal surface of the well, and capable of expanding the bottom portion of the extension tubular of a lowermost one of the multiple extension patch sections that is inserted inside an upper portion of the bottom patch section thereby creating a connection between the bottom patch section and the lowermost one of the multiple extension patch sections.

2. The patching system of claim 1, wherein the bottom portion is adapted to seal with an upper portion of the bottom patch section.

3. The patching system of claim 1, wherein the plurality of ribs acts as an anchor/sealing element.

4. The patching system of claim 1, wherein the plurality of ribs acts as a metal anchoring element.

5. The patching system of claim 1, wherein the expansion device is positioned below the bottom portion of the lowermost one of the multiple extension patch sections.

6. The patching system of claim 1, wherein the expansion device comprises multiple expansion cones.

7. The patching system of claim 1, further including a top patch section including an annular anchor/seal member positioned on an expandable portion of the top patch system.

* * * * *